US005669763A

United States Patent [19]

Pryce et al.

[11] Patent Number: 5,669,763

[45] Date of Patent: Sep. 23, 1997

[54] FUEL PUMP UNIT AND AN ELECTRICAL CONNECTOR THEREFOR

[75] Inventors: John Edward Pryce, Hertford Heath; Richard Johnathon Howells, London, both of Great Britain

[73] Assignee: The Whitaker Corporation, Wilmington, Del.

[21] Appl. No.: 513,467

[22] Filed: Aug. 10, 1995

[30] Foreign Application Priority Data

Aug. 11, 1994 [GB] United Kingdom ..... 9416217

[51] Int. Cl.[6] ..... H01R 13/52

[52] U.S. Cl. ..... 417/313; 417/422; 439/556

[58] Field of Search ..... 417/313, 422; 439/55 C, 559, 553

[56] References Cited

U.S. PATENT DOCUMENTS

| | | | |
|---|---|---|---|
| 3,022,484 | 2/1962 | Thompson | 417/559 X |
| 4,588,247 | 5/1986 | Grappe et al. | 439/556 X |
| 4,653,835 | 3/1987 | Schulte et al. | 439/556 X |
| 4,822,294 | 4/1989 | McClearn | 439/559 X |
| 4,961,018 | 10/1990 | Akhter | 417/422 X |
| 5,207,562 | 5/1993 | Neilbrook et al. | 417/422 X |

*Primary Examiner*—Richard E. Gluck
*Attorney, Agent, or Firm*—Driscoll A. Nina

[57] ABSTRACT

A fuel pump unit comprises a pump supporting flange for closing an opening in a fuel tank. The supporting flange has a wet side from which projects a fuel pump and an opposite dry side from which projects a lip defining a through opening in the supporting flange. An electrical connector has a mating portion for mating with a further connector connected to the power supply for the pump. There depends from the mating portion an insulating block into which have been moulded electrical tabs each having one end projecting into the mating portion and the other end projecting below the insulating block. Leads are connected to these lower portions of the tab terminals by means of electrical clips. The connector is inserted through the opening in the supporting flange from the wet side thereof so that a resilient skirt surrounding the insulating block is force fitted to the inner surface of the lip and a sealing ring is compressed by a flange at the bottom of the skirt, against the wet side of the supporting flange. The leads are then also connected to contacts of the pump.

8 Claims, 3 Drawing Sheets

FUEL PUMP UNIT AND AN ELECTRICAL CONNECTOR THEREFOR

BACKGROUND OF THE INVENTION

1. Field of the Invention

This invention relates to a fuel pump unit for a fuel tank, in particular of an automotive vehicle, and to an electrical connector which is suitable for use with the fuel pump unit.

2. Description of the Prior Art

A known fuel pump unit for a fuel tank of an automotive vehicle, comprises a pump supporting flange, in the form of a disc, for closing an opening in the fuel tank. The supporting flange thus has a wet side and a dry side. An electric fuel pump supported by the flange projects from the wet side of the flange and an electrical connector having an insulating housing fitted in an opening in the supporting flange has a mating portion on the dry side of the supporting flange and a further mating portion on the wet side of the flange. The mating portion on the wet side of the flange mates with a further electrical connector having leads which are connected to respective contacts of the fuel pump. The first mentioned connector is force fitted into the opening from the dry side of the supporting flange. The mating portion of this connector, which portion is on the dry side of the flange, mates with a third connector which is in turn connected to power supply leads for the pump. The connectors may also transmit signals from the fuel level emitter to the fuel gauge of the vehicle. Since the connector which is force fitted into the opening in the supporting flange, is inserted into the opening from the dry side of the flange, gas pressure in the fuel tank will tend to urge the connector out of the opening.

SUMMARY OF THE INVENTION

According to the present invention, a fuel pump unit for a fuel tank, comprises a pump supporting flange for closing an opening in the fuel tank, the supporting flange thus having a wet side and a dry side, an electric fuel pump supported by the flange and projecting from the wet side thereof, and an electrical connector having an insulating housing fitted in an opening in the supporting flange, wherein the housing comprises a mating portion on the dry side of the supporting flange, an annular seal compressing flange surrounding the housing on the wet side of the supporting flange, and an insulating block with a plurality of electrical terminals therein, each terminal having a mating section extending into the mating portion of the housing, and on the wet side of the supporting flange, a lead connecting section electrically connected to a respective insulated electrical lead by means of an insulation displacing electrical clip, the leads being electrically connected to respective electrodes of the pump, a sealing ring on the annular flange being compressed by the annular flange against the wet side of the pump supporting flange to seal the opening therein.

Thus any gas pressure in the fuel tank when the pump unit has been assembled thereto, will serve only more tightly to compress the sealing ring against the wet side of the supporting flange. Economically, the pump unit comprises only one connector which is easy to install by pushing it through the supporting flange from the wet side thereof after which the leads need only be connected to the pump electrodes.

Preferably the connector is such that it can be manufactured in a single operation in that each terminal is simply a flat tab which is moulded into the insulating block during the moulding of the housing.

The insulating block is preferably surrounded by an annular skirt which is slightly oversized with respect to the opening in the supporting flange, but is sufficiently resilient to allow the skirt to be force fitted into the opening, the opening being defined by an annular lip projecting from the dry side of the supporting flange.

In order to avoid tangling of the leads connected to the terminals, the annular flange is preferably provided, on its underside, with clips each for gripping an intermediate portion of a respective one of the insulated leads.

Some of the leads may be connected to a fuel level emitter attached to the pump.

Where the number of leads required, exceeds the number of the terminals, the lead connecting section of at least one of the terminals, may be of a length to receive a plurality of the insulation displacing clips.

An electrical connector according to the present invention, comprises a one piece insulating housing having a mating portion for mating with a mating electrical connector and insulating block depending from the mating portion, a plurality of electrical terminals moulded into the insulating block, each terminal having a mating section projecting into the mating portion of the housing from a first face of the insulating block and a lead connecting portion projecting from the second face of the insulating block opposite to the first face, and an annular skirt having a first part projecting laterally from the insulating block and a stiffly radially compressible second part depending from the first part beside the insulating block in spaced relationship thereto and terminating in an annular flange extending at right angles from the second part and away from the insulating block, the flange having a surface for receiving a sealing ring dimensioned to rest upon the annular flange in surrounding relationship with the second part of the skirt.

The sealing ring preferably comprises an annular body from which project a pair of spaced annular ribs for compression against the annular flange, and a central annual rib for compression against the wet side of the pump supporting flange.

DETAILED DESCRIPTION OF THE PREFERRED EMBODIMENT

Figure 1:
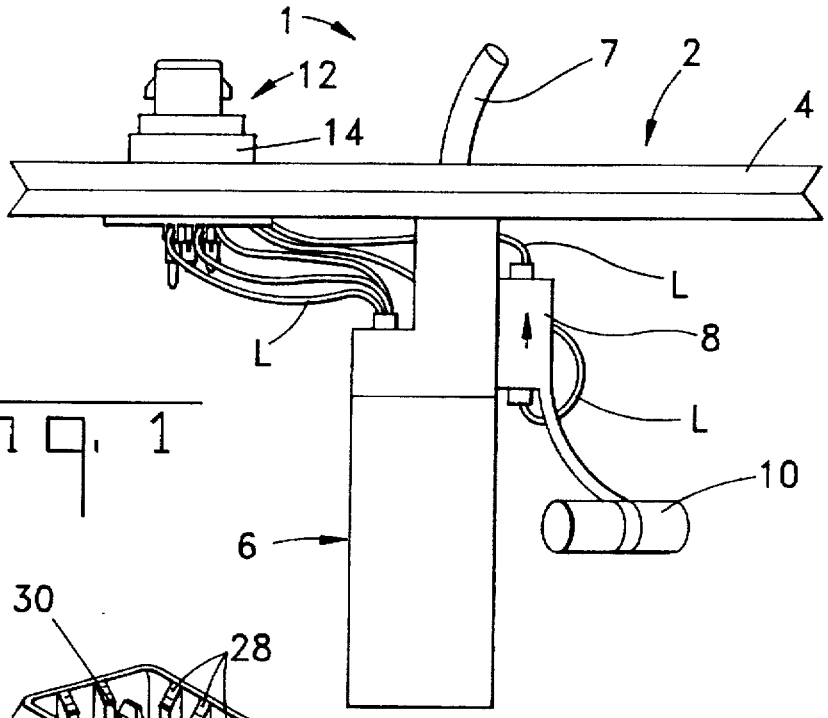
FIG. 1 is a diagrammatic side view of an automotive fuel pump unit comprising an electrical connector according to an embodiment of the present invention.
Figure 7:
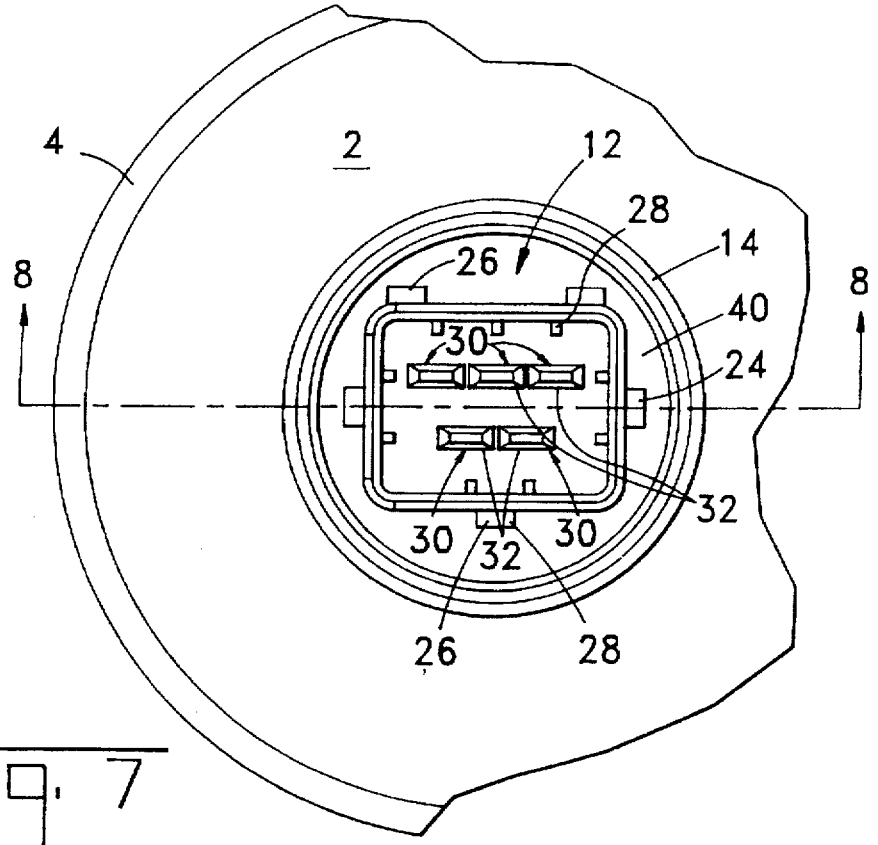
FIG. 7 is an enlarged fragmentary top plan view of the fuel pump unit.
Figure 8:
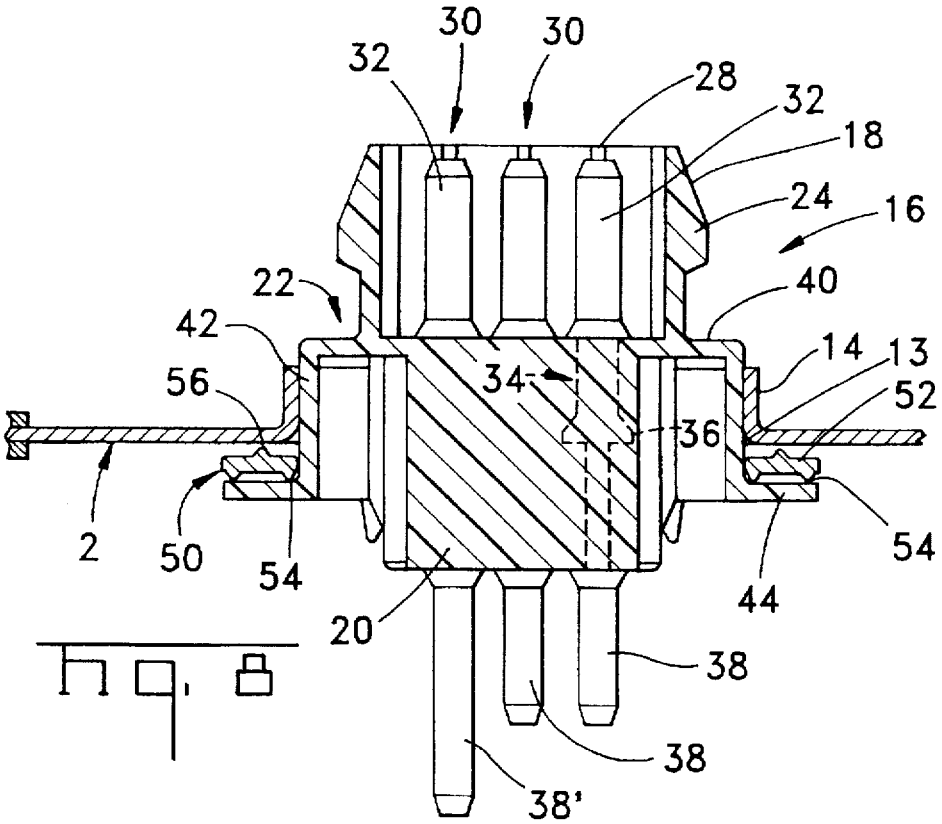
FIG. 8 is a view taken on the lines 8—8 FIG. 7.

As will appear from FIG. 1, 7 and 8 an automotive fuel pump unit 1 comprises a supporting flange 2 in the form of a flat metal disc having a peripheral elastomeric seal 4 by means of which the flange 2 can sealingly close an opening in a fuel tank (not shown) to which the unit 1 is to be assembled. The unit 1 has fixed thereto and depending therefrom, an electric fuel pump 6 having an outlet pipe 7. A fuel gauge emitter 8 having a float 10 is attached to the pump 6. An electrical connector 12 is force fitted into an opening 13 of the supporting flange 2, the opening being defined by an annular lip 14 projecting from the opposite side of the flange 2 to that from which the pump 6 depends. When the unit 1 has been assembled to the fuel tank, the pump 6 and the emitter 8 lie within the fuel tank and the side of the flange 2 from which they project is, therefor, the wet side of the flange 2, the opposite side of the flange 2, from which the pipe 7 and the lip 14 project being the dry side of the flange 2. The connector 12 is mateable, from the dry side of the disc 2 with a further connector (not shown) to conduct power to the pump 6 and to conduct fuel level signals from the emitter 8 to the fuel level gauge of the vehicle in which the fuel tank is installed.

Figure 2:
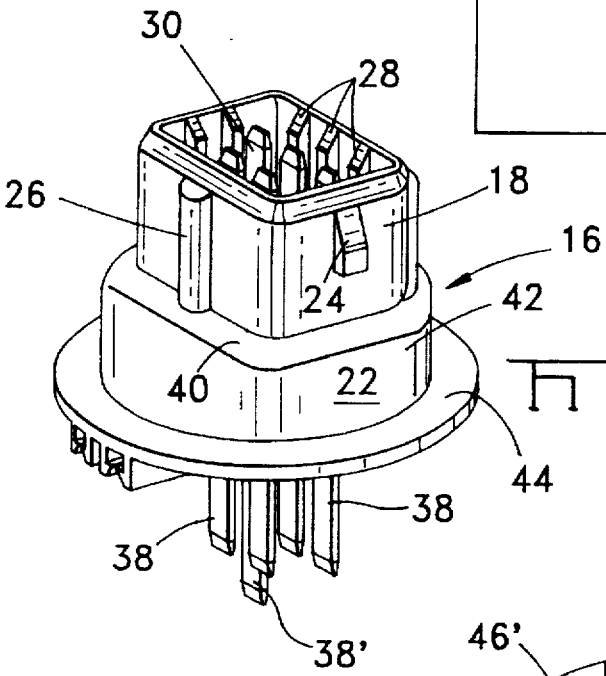
FIG. 2 is an isometric view of the connector without leads connected thereto.
Figure 3:
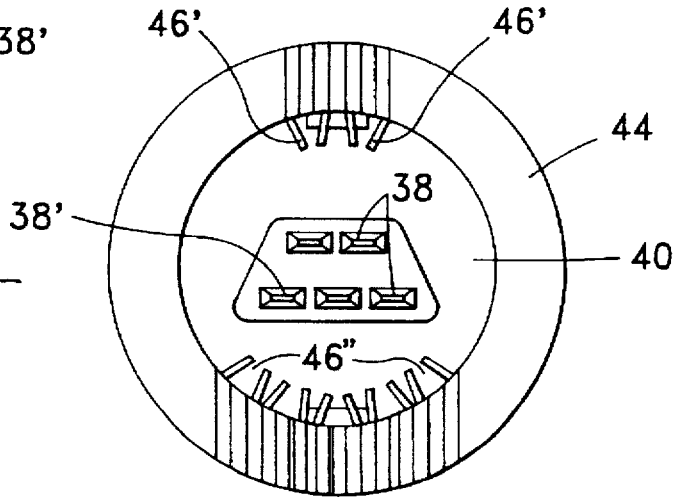
FIG. 3 is an underplan view of the connector shown in FIG. 2.
Figure 4:
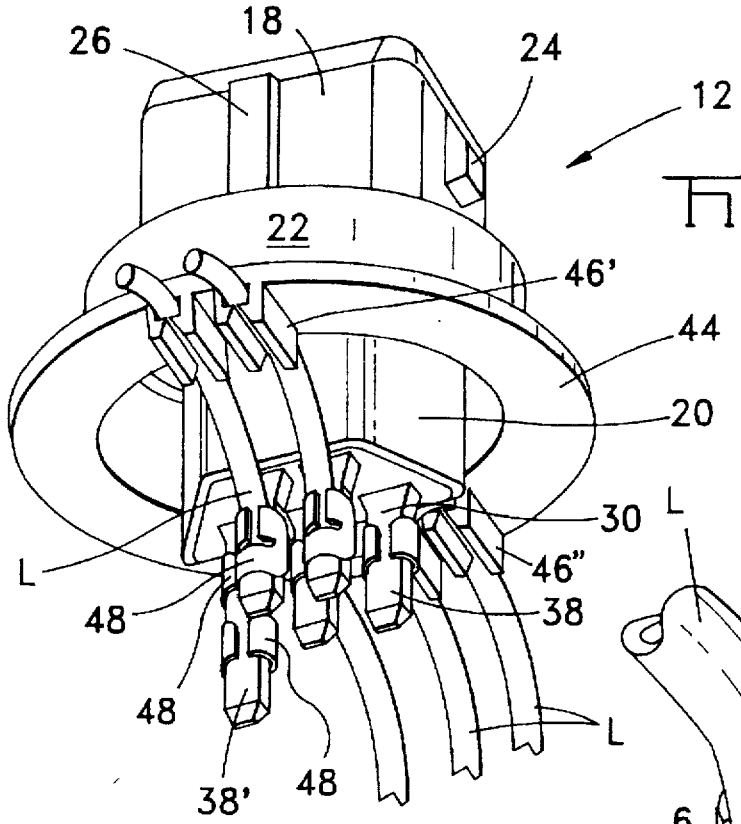
FIG. 4 is an isometric view of the connector with leads connected thereto.

The connector 12 comprises a one piece insulating housing 16 having a tubular mating portion 18 from which depends a terminal carrying insulating block 20. An annular skirt 22 surrounds the block 20 as shown in FIGS. 2, 4 and 8. The mating portion 18 has external latch members 24 for latching engagement with latch arms on the mating connector, and external keyways 26, and internal ribs 28, for cooperation with complimentary means on the mating connector. The block 20 has moulded therein, during the manufacture of the connector 12, five electrical terminals in the form of rectilinear tabs 30 each having a mating section 32 projecting into the mating portion 18 of the housing 16, an intermediate section 34 within the block 20 with laterally projecting retention barbs 36, and a lead connecting section 38 projecting below the block 20. One of the lead connecting sections 38, which is referenced 38', projects below the block 20 to a substantially greater extent than the other lead connecting sections 38. The tabs 30 are arranged in two rows, one row of three tabs and another row of two tabs. The skirt 22 has a first part 40 projecting at right angles from the block 20 and from which the mating portion 18 upstands. A second part 42 of the annular skirt 22 depends at right angles from the first part 40 thereof and terminates in an annular seal compressing flange 44 extending at right angles to the part 22 in a direction away from the block 20. The part 42 and the flange 44 are thus spaced from the block 20. The underside of the flange 44 is formed with a series of lead strain relief 46, namely two clips 46' on one side of the periphery of the flange 44 and four clips 46" which are diametrically opposed to the clips 46', as best seen in FIG. 3.

Figure 5:
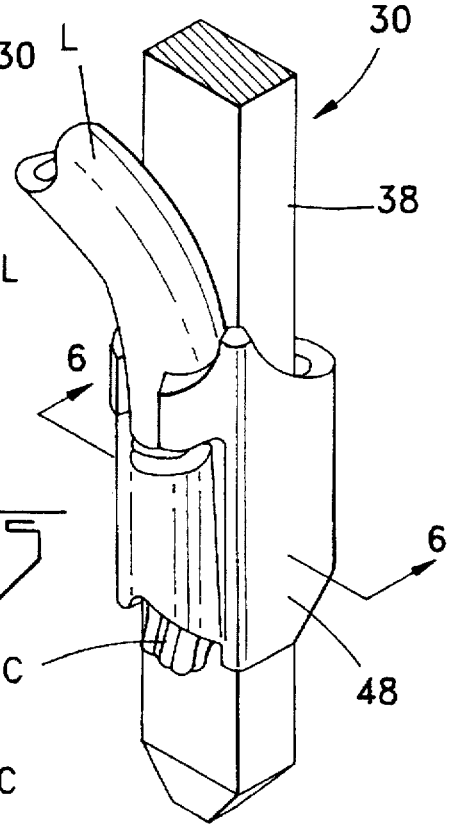
FIG. 5 is an enlarged isometric view of a lead connecting section of a terminal of the connector with an insulated lead electrically connected thereto by means of an insulation displacing electrical clip.
Figure 6:
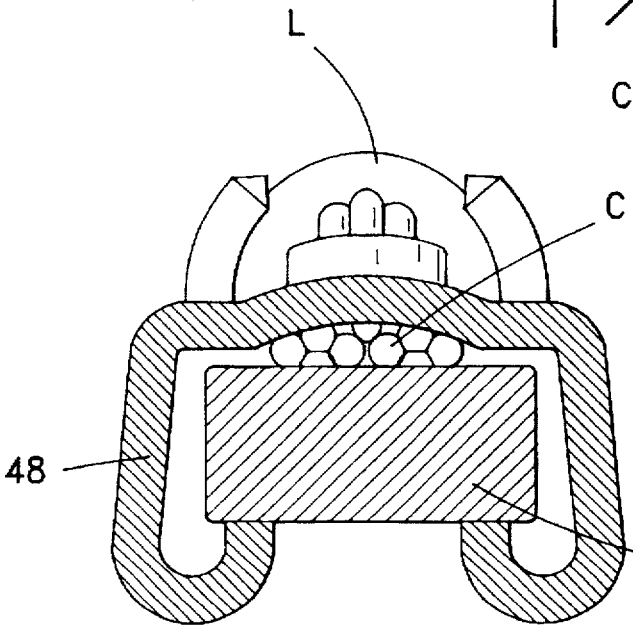
FIG. 6 is an enlarged cross sectional view taken on the lines of 6—6 of FIG. 5.

Before the connector 12 is supplied to an end user for assembly to the supporting disc 2, an insulated lead L is electrically connected to each lead connecting section 38 by means of an insulation displacing electrical clip 48 as best shown in FIGS. 5 and 6. These clips 48 are marketed by companies of the AMP Group for example by AMP of Great Britain Ltd. of Merrion Avenue, Stanmore, Middlesex under the mark TERMIPOINT which is a Trade Mark of AMP Incorporated of Harrisburg, Pa., United States of America. As best seen in FIG. 6, the clips 48 when applied to the lead connecting sections 38, serve resiliently to grip them and to displace the insulation of the leads L and hold the electrically conductive cores C of the leads firmly and permanently down on the sections 38. The electrical clips 48 may be applied to the sections 38 by means of hand tooling or by means of an X-Y programmed applicator, for example. If six, rather than five, leads are required by the end user, two leads are connected to the lead connecting section 38', each by means of a respective clip 38, as shown in FIG. 4. Intermediate portions of the leads L are secured by forcing them into respective ones on the lead clips 46', 46", so as to avoid tangling of the leads L when the connector 12 is being handled. The portions of the leads L beyond the lead clips hang freely as flying leads for connection to the contacts of the pump 6 and the emitter 8. The connector 12 so assembled to the leads L is supplied to the end user together with a loose piece sealing ring 50 (FIG. 8), for example a nitrile sealing ring for encircling the part 42 of the skirt 22 and resting on the upper side of the flange 44. The sealing ring 50 comprises an annular body 52 having radially spaced ribs 54 for resting on the flange 44 and a single central rib 56 projecting oppositely to the ribs 54 and thus away from the flange 44.

In order to assemble the connector 12 to the supporting flange 2, the end user pushes the connector 12 up from the wet side of the supporting flange 2, through the opening 13 defined by the lip 14, with the mating portion 18 of the housing 16 leading and the sealing ring 50 disposed on the upper face of the flange 44 as shown in FIG. 8. The insertion of the connector 12 through the opening 13 is continued until the flange 44 compresses the sealing ring 50 against the wet side of the flange 2, so that the ribs 54 are deformed against the flange 44 and the rib 56 is deformed against the wet side of the supporting flange 2. The part 42 of the skirt 22 of the housing 16 is of slightly greater diameter than the opening 13 but is stiffly resiliently compressible radially to allow it to be received in the opening 13 with the part 42 of the skirt 22 force fitted against the internal surface of the lip 14. The connector is accordingly securely fixed to the supporting flange 2 in sealing tight relationship therewith. The end user then connects the free ends of the flying portions of the leads L to appropriate contacts of the pump 6 and the fuel gauge emitter 8.

When the pump unit 1 has been assembled to the fuel tank, any gas pressure therein will tend to force the connector 12 in its insertion direction, further urging the flange 44 against the sealing ring 50.

We claim:

1. A fuel pump unit for a fuel tank, the pump unit comprising a pump supporting flange for closing an opening in the fuel tank, the supporting flange thus having a wet side and a dry side, an electric fuel pump supported by the flange and projecting from the wet side thereof, and an electrical connector having an insulating housing fitted in an opening in the supporting flange, wherein the housing comprises a mating portion on the dry side of the supporting flange, an annular seal compressing flange surrounding the housing on the wet side of the supporting flange, and an insulating block with a plurality of electrical terminals therein, each terminal having a mating section extending into the mating portion of the housing, and on the wet side of the supporting flange, a lead connecting section electrically connected to a respective insulated electrical lead by means of an insulation displacing electrical clip, the leads being in turn electrically connected to respective contacts of the pump, a sealing ring on the annular flange being compressed by the annular flange against the wet side of the pump supporting flange to seal the opening therein.

2. A pump unit as claimed in claim 1, wherein each terminal is a flat tab moulded into the insulating block and extending therethrough.

3. A pump unit as claimed in claim 1, wherein the annular flange is formed with clips each gripping an intermediate portion of a respective one of the insulated leaks.

4. A pump unit as claimed in claim 1, wherein insulating block is surrounded by a stiffly resiliently skirt force fitted into the opening in the pump supporting flange, the annular flange projecting at right angles from the free edge of the skirt.

5. A pump unit as claimed in claim 4, wherein the skirt is force fitted into an annular lip projecting from the dry side of the pump supporting flange and defining the opening therein.

6. A pump unit as claimed in claim 1, wherein the sealing ring comprises an annular body from which projects a pair of annular ribs compressed against the annular flange and a central annular rib compressed against the wet side of the pump supporting flange.

7. A pump unit as claimed in any one of claims 1, 4 or 5, wherein the pump supporting flange also supports an electrical fuel level emitter, some of the leads being electrically connected to the contacts of the fuel level emitter.

8. A pump unit as claimed in claim 1, wherein at least one of the lead connecting sections of the terminals is electrically connected to a plurality of the leads by means of a plurality of said electrical clips.

* * * * *